United States Patent [19]

Lough

[11] 4,161,835

[45] Jul. 24, 1979

[54] SCATTER SHIELD FOR WEAPON AIMING LIGHT

[75] Inventor: Lewis E. Lough, Springfield, Va.

[73] Assignee: The United States of America as represented by the Secretary of the Army, Washington, D.C.

[21] Appl. No.: 861,138

[22] Filed: Dec. 16, 1977

[51] Int. Cl.[2] ..... F41G 1/36

[52] U.S. Cl. ..... 42/1 A; 362/110

[58] Field of Search ..... 42/1 A, 1 F, 1 ST; 362/110, 32, 290, 259, 293, 342; 89/41 B, 41 L; 33/241, DIG. 21

[56] References Cited

U.S. PATENT DOCUMENTS

| | | | |
|---|---|---|---|
| 1,621,224 | 3/1927 | Scott | 362/290 |
| 1,826,004 | 10/1931 | Key | 362/110 |
| 3,318,033 | 5/1967 | Barr | 42/1 F |
| 3,405,262 | 10/1968 | Dolan et al. | 362/290 |
| 3,863,251 | 1/1975 | Gould et al. | 362/290 |
| 3,867,764 | 2/1975 | Dunmire et al. | 42/1 A |
| 3,919,543 | 11/1975 | Noren | 362/290 |
| 4,048,489 | 9/1977 | Giannetti | 42/1 A |

FOREIGN PATENT DOCUMENTS

| | | | |
|---|---|---|---|
| 1190879 | 4/1959 | France | 362/290 |

*Primary Examiner*—Charles T. Jordan

*Attorney, Agent, or Firm*—Nathan Edelberg; Milton W. Lee; Max L. Harwell

[57] ABSTRACT

A scatter shield and weapon aiming light arrangement wherein the scatter shield is attached to an output end of an aiming light for narrowing the output light beam therefrom. The scatter shield is comprised of a cluster of thin walled, adjacent geometrically shaped tubular sections that are contained in a rigid outer shell and whose internal walls are finished with a flat black, non-reflective coating. The length-to-diameter ratio of the tubular sections of various scatter shields may be chosen to reduce light scatter from the light beam from over a wide angle of about 180° down to only a few degrees.

1 Claim, 5 Drawing Figures

SCATTER SHIELD FOR WEAPON AIMING LIGHT

The invention described herein may be manufactured, used, and licensed by the U.S. Government for governmental purposes without the payment of any royalties thereon.

BACKGROUND OF THE INVENTION

Infrared aiming lights are presently used with night vision equipment as a night firing aid in military operations. An inherent disadvantage to use of such a device is enemy detection of the scattered infrared light emitted therefrom that is inherently a part of the narrow aiming beam for aiming military weapons. Little can be done to eliminate enemy detection of the light transmitted from the infrared aiming light. However, the scattered light that emanates at angles of up to 180° from the output side of the aiming light needs to be eliminated since this wide angle scattered light does no useful work but makes the infrared aiming light more easily detectable by the enemy. The present arrangement of a scatter shield attached by some attachment means on the output side of an aiming light solves the problem by reducing this undersirable scattered light from angles of about 180° down to only a few degrees, such as 20° or less.

SUMMARY OF THE INVENTION

A scatter light reducing means of the present invention may be attached by some attachment means to various night vision equipped weapons using IR aiming lights. The scatter light reducing means may be a scatter shield comprised of various length-to-diameter ratios of internal scatter shield tubular sections surrounded by a rigid outer shell. Some examples of the attachment means for attaching the scatter shield to the aiming light may be clamped or band connected over the output end of the aiming light or screw threaded on the output end of the aiming light.

The scatter shield is comprised of a cluster of thin walled, adjacent geometrically shaped tubular sections that are evenly hollow through their entire length such as hexagonally shaped tubular sections, that are contained in a rigid outer shell. The rigid outer shell furnishes support for the tubular sections and may have an extension for either being clamped or band connected over the output end of the aiming light or may be thickened so that screw threads are cut around the outside perimeter thereof to mesh with internal screw threads at the output end of the aiming light. The screw threads may be external at the output end of the aiming light and internal to the rigid outer shell. The output end of the aiming light, and especially the internal walls of the tubular sections, are finished with a dull, flat black, non-reflective coating.

DETAILED DESCRIPTION OF THE PREFERRED EMBODIMENT

Figure 1:
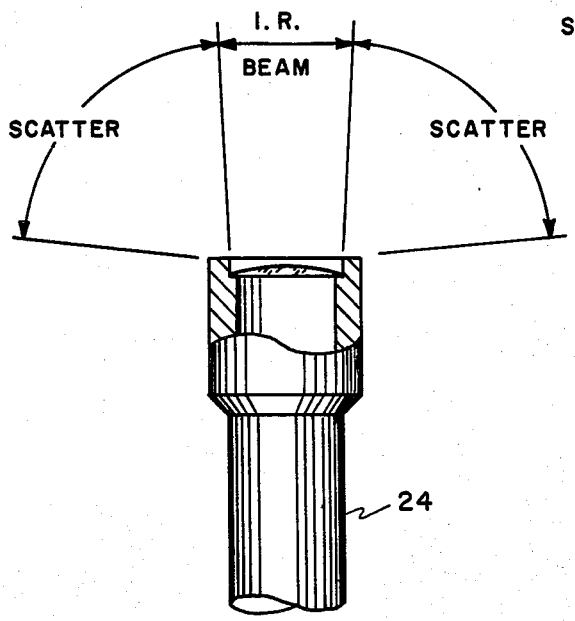
FIG. 1 illustrates a typical output end cutaway of an aiming light where light scatter is widespread.

FIG. 1 is shown to illustrate a cutaway of the output end 24 of an aiming light without the present scatter shield attached thereto, resulting in excessive light scatter.

Figure 2:
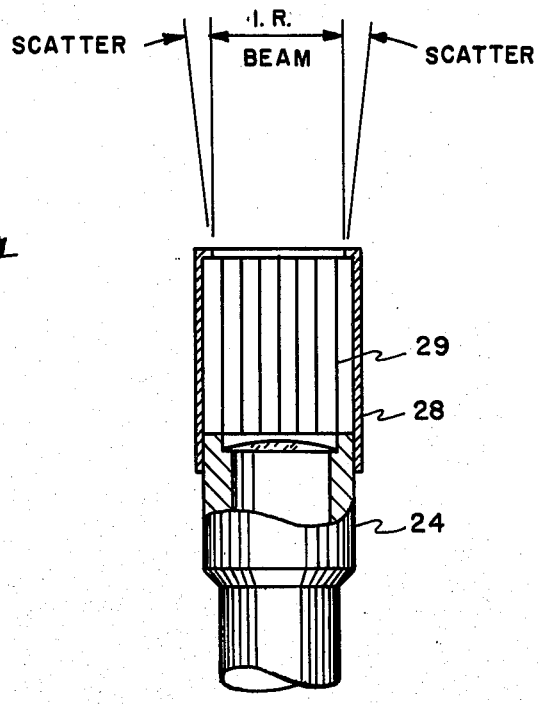
FIG. 2 shows the same cutaway as FIG. 1 but with a scatter shield attached thereto for reducing light scatter.

FIG. 2 illustrates a cutaway of an aiming light output end 24 having a scatter shield 28 attached over the output end thereof wherein the wide angle of light scatter has been greatly reduced by the hexagonal tubular sections 29.

Figure 3:
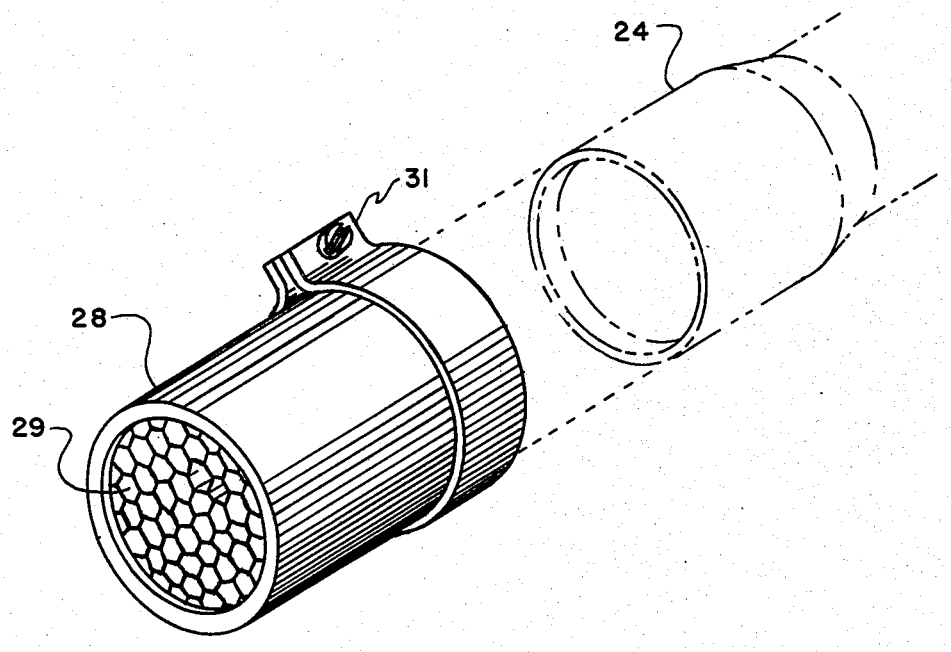
FIG. 3 shows a perspective view of a scatter shield that may be band connected, or clamped, to the output end of the aiming light.

Look also at FIG. 3 for a perspective view of the sections 29. It should be noted that there is no lens associated with the scatter shield 28 itself. This must be the case since if a lens were present, especially at the output end of shield 28, then the scattered light would again be spread after having been narrowed by the tubular sections 29, hereinafter referred to as hexagonal tubular sections but not limited thereto. Sections 29 are therefore hollow all the way through. It is also very important that reflective matter not be present on the end of the scatter shield. This is one of the reasons that the scatter shield 28 is preferably attached to the aiming light by a quick connect-disconnect means, such as screw threading means or by a band tightening means 31, wherein the scatter shield may be easily cleaned, or replaced by a soldier in the field.

The tubular sections 29 may be made of aluminum honeycomb and may be in a hexagonal configuration in which the walls are very thin so that transmission loss is minimized. Alternatively, sections 29 may be made of other metals, such as strainless steel, or non-metals such as plastic that have a wall thickness commensurate with application. Whether the tubular sections 29 are made of metal or non-metal, the entire scatter shield is covered with a flat black, non-reflective coating. The coating may be applied by various coating means, such as brush painting, spraying, or dipping. The geometrically shaped tubular sections may also be circular, square, or some other geometrical shape.

Figure 4:
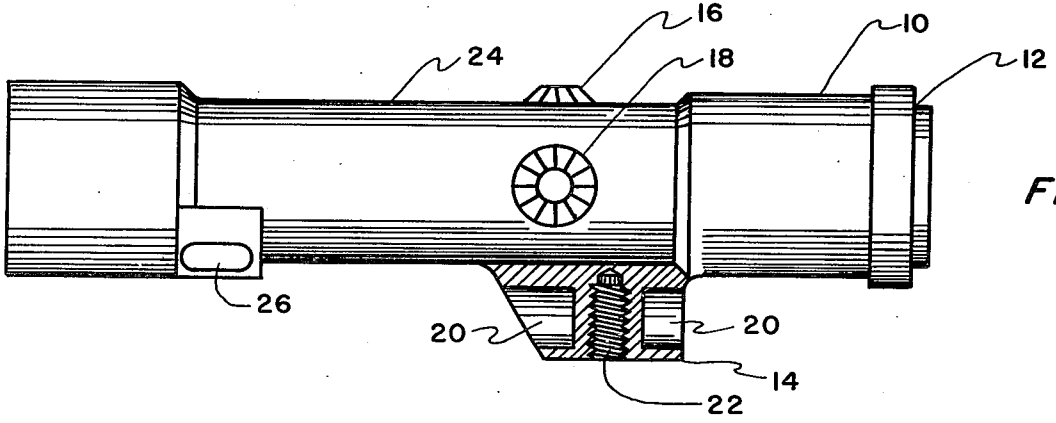
FIG. 4 illustrates an aiming light.
Figure 5:
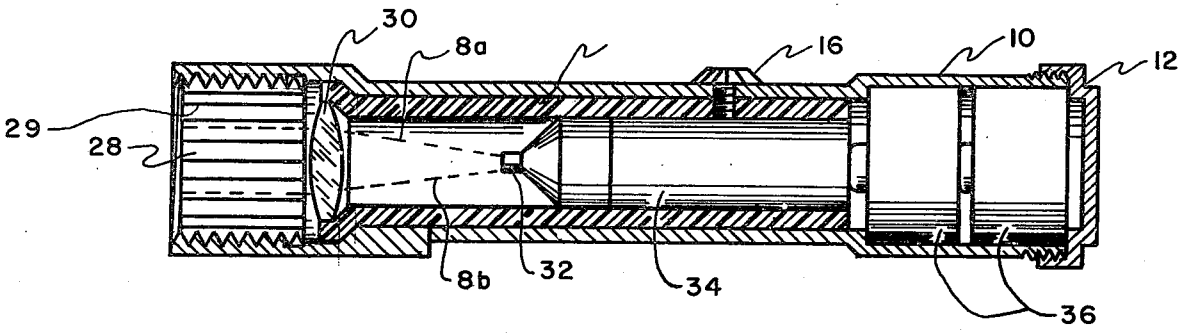
FIG. 5 shows a section that is turned 90° of the same aiming light as illustrated by FIG. 4 with a scatter shield internally screw threaded at the output end thereof.

The scatter shield 28 may also be attached to and used with an aiming light as disclosed herein by FIG. 4 and 5. Also various scatter shields may be configured to be used with prior aiming light such as taught in U.S. Pat. Nos. 3,787,693 by inventor Robert L. Stone and 3,867,764 by co-inventors Howard L. Dunmire and Michael Hacskaylo, in which these patents are commonly assigned to the assignee of this application, i.e. the United States of America as represented by the Secretary of the Army. One example of a particular size of the scatter shield 28 that was used with the aiming light as taught in U.S. Pat. No. 3,867,764 is as follows. The diameter of the flat sides of the hexagonal sections is ⅛ inch and its length is 1¼ inches for a length to diameter ratio of 10:1. Other dimensions may include typical diameters of from ⅛ inch to 3/16 inch between the flat sides of the hexagonal sections, with the lengths of the tubular sections being commensurate with the above example diameters in a length to diameter ratio of 10:1 since this length to diameter ratio is found to minimize the scattered infrared light emitted from an infrared aiming light yet readily allows transmission of the light beam therethrough. The length to diameter ratio is not limited to 10:1 however.

FIGS. 4 and 5 illustrate an aiming light in which the housing 24 is extended at the output end past a refractive lens assembly 30. The extended portion has internal threads therein. A scatter shield 28, having external threads on a rigid outer shell, may be screw threaded into the internal threads of the extended portion. The present aiming light is comprised of two batteries 36 contained within a battery housing section 10 of the aiming light housing 24. An end cap 12 is threadably connected to section 10 and when screw threaded in will press batteries 36 against a laser electrical assembly canister 34 that has a laser diode assembly 32 at its output end. Laser diode assembly 32 projects light beams 8*a* and 8*b* therefrom through refractive lens assembly 30. If the scatter shield 28 comprising the cluster of thin walled, adjacent hexagonally tubular sections 29 were not included at the output end of the aiming light, the angle of the scattered light from light beams 8*a* and 8*b* as they exit the aiming light could be as much as 180°. However, by including the scatter shield 28 with the aiming light the angle of the scattered light may be reduced to about 20°.

Numerals 16 and 18 represent respectively elevation and azimuth internal adjustment screws for canister 34. Numeral 26 represents a dead man switch which requires pressure thereon for the aiming light to be activated. Numeral 14 shows a mounting foot for the aiming light whereby the mounting foot 14 has internal screw threadable mounting means 22 to interface with a bracket shoe on some weapon (not shown). Numeral 20 represents lightening holes in the mounting foot to help keep the overall weight as low as possible.

I claim:

1. A scatter shield assembly attached at the output end of an infrared aiming light for reducing the easily detectable wide angle scattered infrared light accompanying a narrow infrared aiming light beam emanated from said infrared aiming light yet readily allowing transmission of said infrared aiming light beam therethrough, the assembly comprising:

a scatter shield comprised of a cluster of thin walled aluminum honeycomb, adjacent hexagonally shaped tubular sections that are evenly hollow throughout their entire length for allowing easy light transmission therethrough and having a length to diameter ratio of 10:1 with the diameter being measured across the flat sides of the hexagonal shape with said tubular sections being surrounded by a rigid outer shell wherein said scatter shield is finished with a dull flat black, non-reflective coating; and a screw threadably attachment means for attaching said scatter shield at said output end of said infrared aiming light wherein screw threads on the outside of said rigid outer shell mesh with screw threads on the inside of an extension of said output end of said infrared aiming light.

* * * * *